US005216747A

United States Patent [19]

Hardwick et al.

[11] Patent Number: 5,216,747

[45] Date of Patent: Jun. 1, 1993

[54] VOICED/UNVOICED ESTIMATION OF AN ACOUSTIC SIGNAL

[75] Inventors: John C. Hardwick, Cambridge; Jae S. Lim, Winchester, both of Mass.

[73] Assignee: Digital Voice Systems, Inc., Cambridge, Mass.

[21] Appl. No.: 795,803

[22] Filed: Nov. 21, 1991

Related U.S. Application Data

[62] Division of Ser. No. 585,830, Sep. 20, 1990.

[51] Int. Cl.[5] ..... G10L 9/00

[52] U.S. Cl. ..... 395/2

[58] Field of Search ..... 381/29-51; 395/2

[56] References Cited

U.S. PATENT DOCUMENTS

| | | | |
|---|---|---|---|
| 3,706,929 | 12/1972 | Robinson et al. | 381/38 |
| 3,982,070 | 9/1976 | Flanagan | 179/1 |
| 3,995,116 | 11/1976 | Flanagan | 179/1 |
| 4,015,088 | 3/1977 | Dunbnowski et al. | 179/1 SA |
| 4,441,200 | 4/1984 | Fette et al. | 395/2 |
| 4,443,857 | 4/1984 | Albarello | 395/2 |
| 4,672,669 | 6/1987 | DesBlache et al. | 381/46 |
| 4,856,068 | 8/1989 | Quatieri et al. | 381/47 |

OTHER PUBLICATIONS

Griffin, et al., "A New Pitch Detection Algorithm", Digital Signal Processing, No. 84, pp. 395-399, 1984, Elsevier Science Publishers.

Griffin, et al., "A New Model-Based Speech Analysis/-Synthesis System", IEEE International Conference on Acoustics, Speech, and Signal Processing, ICASSP 1985, pp. 513-516.

McAuley, et al., "Mid-Rate Coding Based on a Sinusoidal Representation of Speech", IEEE 1985, pp. 945-948.

McAuley, et al., "Computationally Efficient Sine--Wave Synthesis and Its Application to Sinusoidal Transform Coding", IEEE 1988, pp. 370-373.

Hardwick, "A 4.8 Kbps Multi-Band Excitation Speech Coder", Thesis for Degree of Master of Science in Electrical Engineering and Computer Science, Massachusetts Institute of Technology, May 1988, pp. 1-68.

Griffin, "Multi-Band Excitation Vocoder", Thesis for Degree of Doctor of Philosophy, Massachusetts Institute of Technology, Feb. 1987, pp. 1-131.

(List continued on next page.)

*Primary Examiner*—Michael R. Fleming
*Assistant Examiner*—Michelle Doerrler
*Attorney, Agent, or Firm*—Fish & Richardson

[57] ABSTRACT

The pitch estimation method is improved. Sub-integer resolution pitch values are estimated in making the initial pitch estimate; the sub-integer pitch values are preferably estimated by interpolating intermediate variables between integer values. Pitch regions are used to reduce the amount of computation required in making the initial pitch estimate. Pitch-dependent resolution is used in making the initial pitch estimate, with higher resolution being used for smaller values of pitch. The accuracy of the voiced/unvoiced decision is improved by making the decision dependent on the energy of the current segment relative to the energy of recent prior segments; if the relative energy is low, the current segment favors an unvoiced decision; if high, it favors a voiced decision. Voiced harmonics are generated using a hybrid approach; some voiced harmonics are generated in the time domain, whereas the remaining harmonics are generated in the frequency domain; this preserves much of the computational savings of the frequency domain approach, while at the same time improving speech quality. Voiced harmonics generated in the frequency domain are generated with higher frequency accuracy; the harmonics are frequency scaled, transformed into the time domain with a Discrete Fourier Transform, interpolated and then time scaled.

10 Claims, 5 Drawing Sheets

OTHER PUBLICATIONS

Portnoff, "Short-Time Fourier Analysis of Sampled Speech", IEEE Transactions on Acoustics, Speech, and Signal Processing, vol. ASSP-29, No. 3, Jun. 1981, pp. 324-333.

Griffin, et al., "Signal Estimation from Modified Short-Time Fourier Transform", IEEE Transactions on Acoustics, Speech, and Signal Processing, vol. ASSP-32, No. 2, Apr. 1984, pp. 236-243.

Almeida, et al., "Harmonic Coding: A Low Bit-Rate, Good-Quality Speech Coding Technique", IEEE (1982) CH1746/7/82, pp. 1664-1667.

Quatieri, et al., "Speech Transformations Based on a Sinusoidal Representation", IEEE Transactions on Acoustics, Speech, and Signal Processing, vol. ASSP-34, No. 6, Dec. 1986, pp. 1449-1464.

Griffin, et al., "Multiband Excitation Vocoder", IEEE Transactions on Acoustics, Speech, and Signal Processing, vol. 36, No. 8, Aug., 1988, pp. 1223-1235.

Almeida, et al., "Variable-Frequency Synthesis: An Improved Harmonic Coding Scheme", ICASSP 1984, pp. 27.5.1-27.5.4.

Flanagan, J. L., Speech Analysis Synthesis and Perception, Springer-Verlag, 1982, pp. 378-386.

VOICED/UNVOICED ESTIMATION OF AN ACOUSTIC SIGNAL

This is a division of application Ser. No. 07/585,830, filed Sep. 20, 1990.

BACKGROUND OF THE INVENTION

This invention relates to methods for encoding and synthesizing speech.

Relevant publications include: J.L., *Speech Analysis, Synthesis and Perception*, Springer-Verlag, 1972, pp. 378–386, (discusses phase vocoder - frequency-based speech analysis-synthesis system); Quatieri, et al., "Speech Transformations Based on a Sinusoidal Representation", IEEE TASSP, Vol, ASSP34, No. 6, December, 1986pp. 1449–1986, (discusses analysis-synthesis technique based on a sinusoidal representation); Griffin, et al., "Multi-band Excitation Vocoder", Ph.D. Thesis, M.I.T, 1987, (discusses Multi-Band Excitation analysis-synthesis); Griffin, et al., "A New Pitch Detection Algorithm", Int. Conf. on DSP, Florence, Italy, Sept. 5–8, 1984, (discusses pitch estimation); Griffin, et al., "A New Model-Based Speech Analysis/Synthesis System", Proc ICASSP 85, pp. 513–516, Tampa, Fla., Mar. 26–29, 1985, (discusses alternative pitch likelihood functions and voicing measures); Hardwick, "A 4.8 kbps Multi-Band Excitation Speech Coder", S.M. Thesis, M.I.T, May 1988, (discusses a 4.8 kbps speech coder based on the Multi-Band Excitation speech model); McAulay et al., "Mid-Rate Coding Based on a Sinusoidal Representation of Speech", Proc. ICASSP 85, pp. 945–948, Tampa, Fla., Mar. 26–29, 1985, (discusses speech coding based on a sinusoidal representation); Almieda et al., "Harmonic Coding with Variable Frequency Synthesis", Proc. 1983 Spain Workshop on Sig. Proc. and its Applications", Sitges, Spain, September, 1983, (discusses time domain voiced synthesis); Almieda et al., "Variable Frequency Synthesis: An Improved Harmonic Coding Scheme", Proc ICASSP 84, San Diego, Calif., pp. 289–292, 1984, (discusses time domain voiced synthesis); McAulay et al., "Computationally Efficient Sine-Wave Synthesis and its Application to Sinusoidal Transform Coding", Proc. ICASSP 88, New York, N.Y., pp. 370–373, April 1988, (discusses frequency domain voiced synthesis); Griffin et al., "Signal Estimation From Modified Short-Time Fourier Transform", IEEE TASSP, Vol. 32, No. 2, pp. 236–243, April 1984, (discusses weighted overlap-add synthesis). The contents of these publications are incorporated herein by reference.

The problem of analyzing and synthesizing speech has a large number of applications, and as a result has received considerable attention in the literature. One class of speech analysis/synthesis systems (vocoders) which have been extensively studied and used in practice is based on an underlying model of speech. Examples of vocoders include linear prediction vocoders, homomorphic vocoders, and channel vocoders. In these vocoders, speech is modeled on a short-time basis as the response of a linear system excited by a periodic impulse train for voiced sounds or random noise for unvoiced sounds. For this class of vocoders, speech is analyzed by first segmenting speech using a window such as a Hamming window. Then, for each segment of speech, the excitation parameters and system parameters are determined. The excitation parameters consist of the voiced/unvoiced decision and the pitch period.

The system parameters consist of the spectral envelope or the impulse response of the system. In order to synthesize speech, the excitation parameters are used to synthesize an excitation signal consisting of a periodic impulse train in voiced regions or random noise in unvoiced regions. This excitation signal is then filtered using the estimated system parameters.

Even though vocoders based on this underlying speech model have been quite successful in synthesizing intelligible speech, they have not been successful in synthesizing high-quality speech. As a consequence, they have not been widely used in applications such as time-scale modification of speech, speech enhancement, or high-quality speech coding. The poor quality of the synthesized speech is in part, due to the inaccurate estimation of the pitch, which is an important speech model parameter.

To improve the performance of pitch detection, a new method was developed by Griffin and Lim in 1984. This method was further refined by Griffin and Lim in 1988. This method is useful for a variety of different vocoders, and is particularly useful for a Multi-Band Excitation (MBE) vocoder.

Let s(n) denote a speech signal obtained by sampling an analog speech signal. The sampling rate typically used for voice coding applications ranges between 6 khz and 10 khz. The method works well for any sampling rate with corresponding change in the various parameters used in the method.

We multiply s(n) by a window w(n) to obtain a windowed signal $s_w(n)$. The window used is typically a Hamming window or Kaiser window. The windowing operation picks out a small segment of s(n). A speech segment is also referred to as a speech frame.

The objective in pitch detection is to estimate the pitch corresponding to the segment $s_w(n)$. We will refer to $s_w(n)$ as the current speech segment and the pitch corresponding to the current speech segment will be denoted by $P_0$, where "0" refers to the "current" speech segment. We will also use P to denote $P_0$ for convenience. We then slide the window by some amount (typically around 20 msec or so), and obtain a new speech frame and estimate the pitch for the new frame. We will denote the pitch of this new speech segment as $P_1$. In a similar fashion, $P_{-1}$ refers to the pitch of the past speech segment. The notations useful in this description are $P_0$ corresponding to the pitch of the current frame, $P_{-2}$ and $P_{-1}$ corresponding to the pitch of the past two consecutive speech frames, and $P_1$ and $P_2$ corresponding to the pitch of the future speech frames.

The synthesized speech at the synthesizer, corresponding to $\hat{s}_w(n)$ will be denoted by $\hat{s}_w(n)$. The Fourier transforms of $\hat{s}_w(n)$ and $s_w(n)$ will be denoted by $S_w(w)$ and $S_w(w)$.

The overall pitch detection method is shown in FIG. 1. The pitch P is estimated using a two-step procedure. We first obtain an initial pitch estimate denoted by $\hat{P}_I$. The initial estimate is restricted to integer values. The initial estimate is then refined to obtain the final estimate P, which can be a non-integer value. The two-step procedure reduces the amount of computation involved.

To obtain the initial pitch estimate, we determine a pitch likelihood function, E(P), as a function of pitch. This likelihood function provides a means for the numerical comparison of candidate pitch values. Pitch tracking is used on this pitch likelihood function as shown in FIG. 2. In all our discussions in the initial pitch estimation, P is restricted to integer values. The function E(P) is obtained by, $$E(P) = \frac{\sum_{j=-\infty}^{\infty} s^2(j)w^2(j) - P \cdot \sum_{n=-\infty}^{\infty} r(n \cdot P)}{\left(\sum_{j=-\infty}^{\infty} s^2(j)w^2(j)\right)\left(1 - P \cdot \sum_{j=-\infty}^{\infty} w^2(j)\right)} \quad (1)$$

where r(n) is an autcorrelation function given by $$r(n) = \sum_{j=-\infty}^{\infty} s(j)w^2(j)s(j+n)w^2(j+n) \quad (2)$$

and where, $$\sum_{j=-\infty}^{\infty} w^2(j) = 1 \quad (3)$$

Equations (1) and (2) can be used to determine E(P) for only integer values of P, since s(n) and w(n) are discrete signals.

The pitch likelihood function E(P) can be viewed as an error function, and typically it is desirable to choose the pitch estimate such that E(P) is small. We will see soon why we do not simply choose the P that minimizes E(P). Note also that E(P) is one example of a pitch likelihood function that can be used in estimating the pitch. Other reasonable functions may be used.

Pitch tracking is used to improve the pitch estimate by attempting to limit the amount the pitch changes between consecutive frames. If the pitch estimate is chosen to strictly minimize E(P), then the pitch estimate may change abruptly between succeeding frames. This abrupt change in the pitch can cause degradation in the synthesized speech. In addition, pitch typically changes slowly; therefore, the pitch estimates from neighboring frames can aid in estimating the pitch of the current frame.

Look-back tracking is used to attempt to preserve some continuity of P from the past frames. Even though an arbitrary number of past frames can be used, we will use two past frames in our discussion.

Let $\hat{P}_{-1}$ and $\hat{P}_{-2}$ denote the initial pitch estimates of $P_{-1}$ and $\hat{P}_{-2}$. In the current frame processing, $\hat{P}_{-1}$ and $\hat{P}_{-2}$ are already available from previous analysis. Let $E_{-1}(P)$ and $E_{-2}(P)$ denote the functions of Equation (1) obtained from the previous two frames. Then $E_{-1}(\hat{P}_{-1})$ and $E_{-2}(\hat{P}_{-2})$ will have some specific values.

Since we want continuity of P, we consider P in the range near $\hat{P}_{-1}$. The typical range used is $$(1-\alpha)\cdot\hat{P}_{-1} \leqq P \leqq (1+\alpha)\cdot\hat{P}_{-1} \quad (4)$$

where $\alpha$ is some constant.

We now choose the P that has the minimum E(P) within the range of P given by (4). We denote this P as P*. We now use the following decision rule.

$$\text{If } E_{-2}(\hat{P}_{-2}) + E_{-1}(\hat{P}_{-1}) + E(P^*) \leqq \text{Threshold},$$

$$\hat{P}_I = P^* \text{ where } \hat{P}_I \text{ is the initial pitch estimate of P.} \quad (5)$$

If the condition in Equation (5) is satisfied, we now have the initial pitch estimate $P_I$. If the condition is not satisfied, then we move to the looK-ahead tracking.

Look-ahead tracking attempts to preserve some continuity of P with the future frames. Even though as many frames as desirable can be used, we will use two future frames for our discussion. From the current frame, we have E(P). We can also compute this function for the next two future frames. We will denote these as $E_1(P)$ and $E_2(P)$. This means that there will be a delay in processing by the amount that corresponds to two future frames.

We consider a reasonable range of P that covers essentially all reasonable values of P corresponding to human voice. For speech sampled at 8 khz rate, a good range of P to consider (expressed as the number of speech samples in each pitch period) is $22 \leqq P < 115$.

For each P within this range, we choose a $P_1$ and $P_2$ such that CE(P) as given by (6) is minimized, $$CE(P) = E(P) + E_1(P_1) + E_2(P_2) \quad (6)$$

subject to the constraint that $P_1$ is "close" to P and $P_2$ is "close" to $P_1$. Typically these "closeness" constraints are expressed as:

$$(1-\alpha)P \leqq P_1 \leqq (1+\alpha)P \quad (7)$$

and $$(1-\beta)P_1 \leqq P_2 \leqq (1+\beta)P_1 \quad (8)$$

This procedure is sketched in FIG. 3. Typical values for $\alpha$ and $\beta$ are $\alpha = \beta = 0.2$ For each P, we can use the above procedure to obtain CE(P). We then have CE(P) as a function of P. We use the notation CE to denote the "cumulative error".

Very naturally, we wish to choose the P that gives the minimum CE(P). However there is one problem called "pitch doubling problem". The pitch doubling problem arises because CE(2P) is typically small when CE(P) is small. Therefore, the method based strictly on the minimization of the function CE(.) may choose 2P as the pitch even though P is the correct choice. When the pitch doubling problem occurs, there is considerable degradation in the quality of synthesized speech. The pitch doubling problem is avoided by using the method described below. Suppose P' is the value of P that gives rise to the minimum CE(P). Then we consider P=P', P'/2, P'/3, P'/4, . . . in the allowed range of P (typically $22 \leqq P < 115$). If P'/2, P'/3, P'/4, . . . are not integers, we choose the integers closest to them. Let's suppose P', P'/2 and P'/3, are in the proper range. We begin with the smallest value of P, in this case P'/3, and use the following rule in the order presented.

If (9)

$$CE\left(\frac{P}{3}\right) \leqq \alpha_1 \text{ and } \frac{CE\left(\frac{P}{3}\right)}{CE(P)} \leqq \alpha_2, \text{ then } \hat{P}_F = \frac{P}{3}.$$

where $P_F$ is the estimate from forward look-ahead feature.

If (10)

$$CE\left(\frac{P}{3}\right) \leqq \beta_1 \text{ and } \frac{CE\left(\frac{P}{3}\right)}{CE(P)} \leqq \beta_2, \text{ then } \hat{P}_F = \frac{P}{3}.$$

Some typical values of $\alpha_1$, $\alpha_2$, $\beta_1$, $\beta_2$ are:

$\alpha_1 = .15 \quad \alpha_2 = 5.0$
$\beta_1 = .75 \quad \beta_2 = 2.0$

If P'/3 is not chosen by the above rule, then we go to the next lowest, which is P'/2 in the above example. Eventually one will be chosen, or we reach P=P'. If P=P' is reached without any choice, then the estimate $P_F$ is given by P'.

The final step is to compare $P_F$ with the estimate obtained from look-back tracking, P*. Either $P_F$ or P* is chosen as the initial pitch estimate, $P_I$, depending upon the outcome of this decision. One common set of decision rules which is used to compare the two pitch estimates is:

If $$CE(\hat{P}_F) < E_{-2}(\hat{P}_{-2}) + E_{-1}(\hat{P}_{-1}) + E(P^*) \text{ then } P_I = P_F \tag{11}$$

Else if $$CE(\hat{P}_F) \geqq E_{-2}(\hat{P}_{-2}) + E_{-1}(\hat{P}_{-1}) + E(\hat{P}^*) \text{ then } P_I = P^* \tag{12}$$

Other decision rules could be used to compare the two candidate pitch values.

The initial pitch estimation method discussed above generates an integer value of pitch. A block diagram of this method is shown in FIG. 4. Pitch refinement increases the resolution of the pitch estimate to a higher sub-integer resolution. Typically the refined pitch has a resolution of ¼ integer or ⅛ integer.

We consider a small number (typically 4 to 8) of high resolution values of P near $P_I$. We evaluate $E_r(P)$ given by $$E_r(P) = \int_{\omega=-\pi}^{\pi} G(\omega)|\hat{S}_w(\omega) - \hat{S}_w(\omega)|^2 d\omega \tag{13}$$

where $G(\omega)$ is an arbitrary weighting function and where $$S_w(\omega) = \sum_{n=-\infty}^{\infty} s_w(n)e^{-j\omega n} \tag{14}$$

and $$\hat{S}_w(\omega) = \sum_{m=-\infty}^{\infty} A_M W_r(\omega - m\omega_0) \tag{15}$$

The parameter $\omega_0 \doteq 2\pi/P$ is the fundamental frequency and $W_r(\omega)$ is the Fourier Transform of the pitch refinement window, $w_r(n)$ (see FIG. 1). The complex coefficients, $A_M$, in (16), represent the complex amplitudes at the harmonics of $\omega_0$. These coefficients are given by $$A_M = \frac{\int_{a_M}^{b_M} S_w(\omega) W_r(\omega - m\omega_0) d\omega}{\int_{a_M}^{b_M} |W_r(\omega - M\omega_0)|^2 d\omega} \tag{16}$$

where $$a_M = (m - .5)\omega_0 \text{ and } b_M = (m + .5)\omega_0 \tag{17}$$

The form of $S_w(\omega)$ given in (15) corresponds to a voiced or periodic spectrum.

Note that other reasonable error functions can be used in place of (13), for example $$\hat{E}_r(P) = \int_{-\pi}^{\pi} G(\omega)|\hat{S}_w(\omega) - S_w(\omega)|^2 d\omega \tag{18}$$

Typically the window function $w_r(n)$ is different from the window function used in the initial pitch estimation step.

An important speech model parameter is the voicing-/unvoicing information. This information determines whether the speech is primarily composed of the harmonics of a single fundamental frequency (voiced), or whether it is composed of wideband "noise like" energy (unvoiced). In many previous vocoders, such as Linear Predictive Vocoders or Homomorphic Vocoders, each speech frame is classified as either entirely voiced or entirely unvoiced. In the MBE vocoder the speech spectrum, $S_w(\omega)$, is divided into a number of disjoint frequency bands, and a single voiced/unvoiced (V/UV) decision is made for each band.

The voiced/unvoiced decisions in the MBE vocoder are determined by dividing the frequency range $0 \leqq \omega \leqq \pi$ into L bands as shown in FIG. 5. The constants $\Omega_0 = 0, \Omega_1, \ldots \Omega_{L-1}, \Omega_L = \pi$, are the boundaries between the L frequency bands. Within each band a V/UV decision is made by comparing some voicing measure with a known threshold. One common voicing measure is given by $$D_i = \frac{\int_{\Omega_i}^{\Omega_{i+1}} |S_w(\omega) - \hat{S}_w(\omega)|^2 d\omega}{\int_{\Omega_i}^{\Omega_{i+1}} |S_w(\omega)|^2 d\omega} \tag{19}$$

where $\hat{S}_w(\omega)$ is given by Equations (15) through (17). Other voicing measures could be used in place (19). One example of an alternative voicing measure is given by $$D_i = \frac{\int_{\Omega_i}^{\Omega_{i+1}} ||S_w(\omega)| - |\hat{S}_w(\omega)||^2 d\omega}{\int_{\Omega_i}^{\Omega_{i+1}} |S_w(\omega)|^2 d\omega} \tag{20}$$

The voicing measure $D_l$ defined by (19) is the difference between $S_w(\omega)$ and $S_w(\omega)$ over the l'th frequency band, which corresponds to $\Omega_l < \omega < \Omega_{l+1}$. $D_l$ is compared against a threshold function. If $D_l$ is less than the threshold function then the l'th frequency band is determined to be voiced. Otherwise the l'th frequency band is determined to be unvoiced. The threshold function typically depends on the pitch, and the center frequency of each band.

In a number of vocoders, including the MBE Vocoder, the Sinusoidal Transform Coder, and the Harmonic Coder the synthesized speech is generated all or in part by the sum of harmonics of a single fundamental frequency. In the MBE vocoder this comprises the voiced portion of the synthesized speech, v(n). The unvoiced portion of the synthesized speech is generated separately and then added to the voiced portion to produce the complete synthesized speech signal.

There are two different techniques which have been used in the past to synthesize a voiced speech signal. The first technique synthesizes each harmonic separately in the time domain using a bank of sinusiodal oscillators. The phase of each oscillator is generated from a low-order piecewise phase polynomial which smoothly interpolates between the estimated parameters. The advantage of this technique is that the resulting speech quality is very high. The disadvantage is that a large number of computations are needed to generate each sinusiodal oscillator. This computational cost of this technique may be prohibitive if a large number of harmonics must be synthesized.

The second technique which has been used in the past to synthesize a voiced speech signal is to synthesize all of the harmonics in the frequency domain, and then to use a Fast Fourier Transform (FFT) to simultaneously convert all of the synthesized harmonics into the time domain. A weighted overlap add method is then used to smoothly interpolate the output of the FFT between speech frames. Since this technique does not require the computations involved with the generation of the sinusoidal oscillators, it is computationally much more efficient than the time-domain technique discussed above. The disadvantage of this technique is that for typical frame rates used in speech coding (20–30 ms.), the voiced speech quality is reduced in comparison with the time-domain technique.

SUMMARY OF THE INVENTION

In a first aspect, the invention features an improved pitch estimation method in which sub-integer resolution pitch values are estimated in making the initial pitch estimate. In preferred embodiments, the non-integer values of an intermediate autocorrelation function used for sub-integer resolution pitch values are estimated by interpolating between integer values of the autocorrelation function.

In a second aspect, the invention features the use of pitch regions to reduce the amount of computation required in making the initial pitch estimate. The allowed range of pitch is divided into a plurality of pitch values and a plurality of regions. All regions contain at least one pitch value and at least one region contains a plurality of pitch values. For each region a pitch likelihood function (or error function) is minimized over all pitch values within that region, and the pitch value corresponding to the minimum and the associated value of the error function are stored. The pitch of a current segment is then chosen using look-back tracking, in which the pitch chosen for a current segment is the value that minimizes the error function and is within a first predetermined range of regions above or below the region of a prior segment. Look-ahead tracking can also be used by itself or in conjunction with look-back tracking; the pitch chosen for the current segment is the value that minimizes a cumulative error function. The cumulative error function provides an estimate of the cumulative error of the current segment and future segments, with the pitches of future segments being constrained to be within a second predetermined range of regions above or below the region of the current segment. The regions can have nonuniform pitch width (i.e., the range of pitches within the regions is not the same size for all regions).

In a third aspect, the invention features an improved pitch estimation method in which pitch-dependent resolution is used in making the initial pitch estimate, with higher resolution being used for some values of pitch (typically smaller values of pitch) than for other values of pitch (typically larger values of pitch).

In a fourth aspect, the invention features improving the accuracy of the voiced/unvoiced decision by making the decision dependent on the energy of the current segment relative to the energy of recent prior segments. If the relative energy is low, the current segment favors an unvoiced decision; if high, the current segment favors a voiced decision.

In a fifth aspect, the invention features an improved method for generating the harmonics used in synthesizing the voiced portion of synthesized speech. Some voiced harmonics (typically low-frequency harmonics) are generated in the time domain, whereas the remaining voiced harmonics are generated in the frequency domain. This preserves much of the computational savings of the frequency domain approach, while it preserves the speech quality of the time domain approach.

In a sixth aspect, the invention features an improved method for generating the voiced harmonics in the frequency domain. Linear frequency scaling is used to shift the frequency of the voiced harmonics, and then an Inverse Discrete Fourier Transform (DFT) is used to convert the frequency scaled harmonics into the time domain. Interpolation and time scaling are then used to correct for the effect of the linear frequency scaling. This technique has the advantage of improved frequency accuracy.

Other features and advantages of the invention will be apparent from the following description of preferred embodiments and from the claims.

DESCRIPTION OF PREFERRED EMBODIMENTS OF THE INVENTION

In the prior art, the initial pitch estimate is estimated with integer resolution. The performance of the method can be improved significantly by using sub-integer resolution (e.g. the resolution of ½ integer). This requires modification of the method. If E(P) in Equation (1) is used as an error criterion, for example, evaluation of E(P) for non-integer P requires evaluation of r(n) in (2) for non-integer values of n. This can be accomplished by $$r(n+d)=(1-d)\cdot r(n)+d\cdot r(n+1) \text{ for } 0\leqq d\leqq 1 \quad (21)$$

Figure 1:
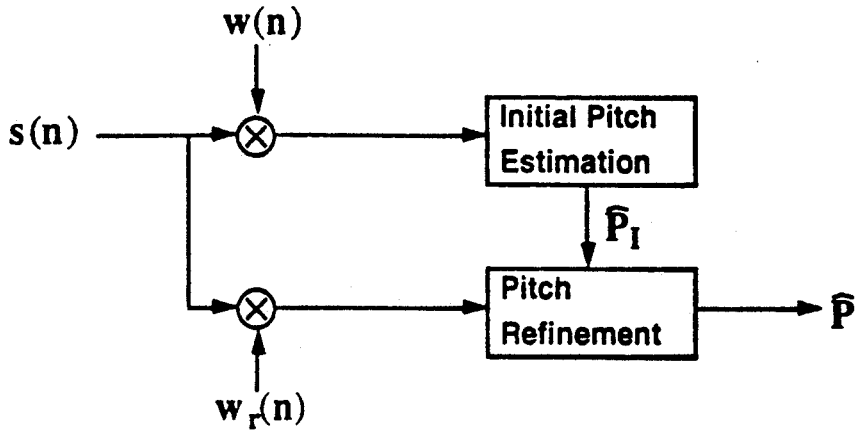
PRIOR ART FIG. 1
FIGS. 1–5 are diagrams showing prior art pitch estimation methods.
Figure 2:
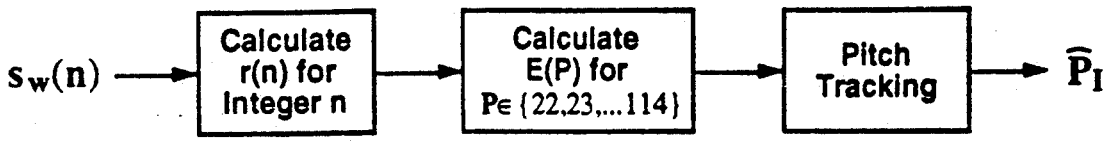
PRIOR ART FIG. 2
Figure 3:
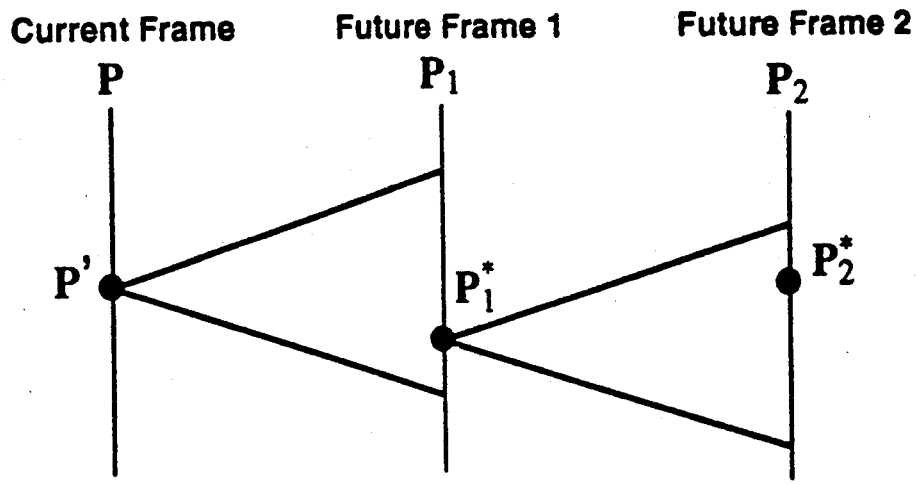
PRIOR ART FIG. 3
Figure 4:
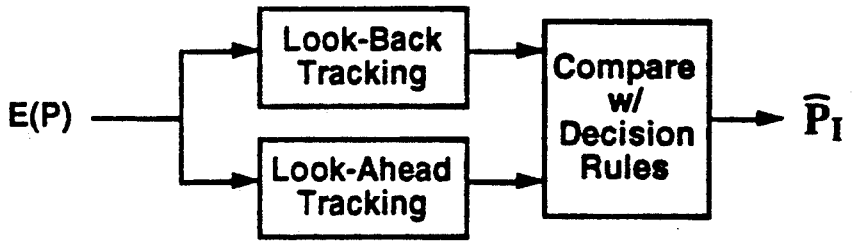
PRIOR ART FIG. 4
Figure 5:
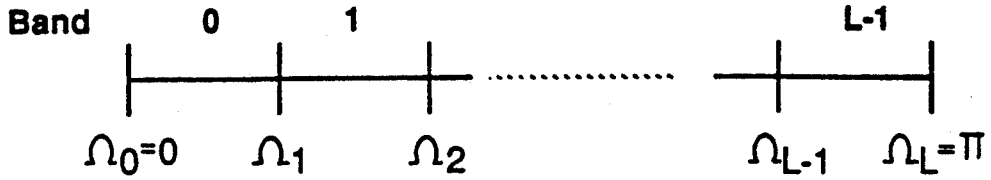
PRIOR ART FIG. 5
Figure 6:
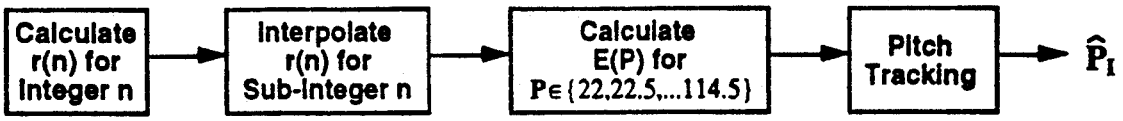
FIG. 6 is a flow chart showing a preferred embodiment of the invention in which sub-integer resolution pitch values are estimated.

Equation (21) is a simple linear interpolation equation; however, other forms of interpolation could be used instead of linear interpolation. The intention is to require the initial pitch estimate to have sub-integer resolution, and to use (21) for the calculation of E(P) in (1). This procedure is sketched in FIG. 6.

In the initial pitch estimate, prior techniques typically consider approximately 100 different values ($22\leqq P<115$) of P. If we allow sub-integer resolution, say ½ integer, then we have to consider 186 different values of P. This requires a great deal of computation, particularly in the look-ahead tracking. To reduce computations, we can divide the allowed range of P into a small number of non-uniform regions. A reasonable number is 20. An example of twenty non-uniform regions is as follows:

| | |
|---|---|
| Region 1 | $22 \leqq P < 24$ |
| Region 2: | $24 \leqq P < 26$ |
| Region 3: | $26 \leqq P < 28$ |
| Region 4: | $28 \leqq P < 31$ |
| Region 5: | $31 \leqq P < 34$ |
| Region 19: | $99 \leqq P < 107$ |
| Region 20: | $107 \leqq P < 115$ |

Within each region, we keep the value of P for which E(P) is minimum and the corresponding value of E(P). All other information concerning E(P) is discarded. The pitch tracking method (look-back and look-ahead) uses these values to determine the initial pitch estimate, $P_1$. The pitch continuity constraints are modified such that the pitch can only change by a fixed number of regions in either the look-back tracking or look-ahead tracking.

For example if $P_{-1}=26$, which is in pitch region 3, then P may be constrained to lie in pitch region 2, 3 or 4. This would correspond to an allowable pitch difference of 1 region in the "look-back" pitch tracking.

Similarly, if $P=26$, which is in pitch region 3, then $P_1$ may be constrained to lie in pitch region 1, 2, 3, 4 or 5. This would correspond to an allowable pitch difference of 2 regions in the "look-ahead" pitch tracking. Note how the allowable pitch difference may be different for the "look-ahead" tracking than it is for the "look-back" tracking. The reduction of from approximately 200 values of P to approximately 20 regions reduces the computational requirements for the look-ahead pitch tracking by orders of magnitude with little difference in performance. In addition the storage requirements are reduced, since E(P) only needs to be stored at 20 different values of $P_1$ rather than 100–200.

Figure 7:
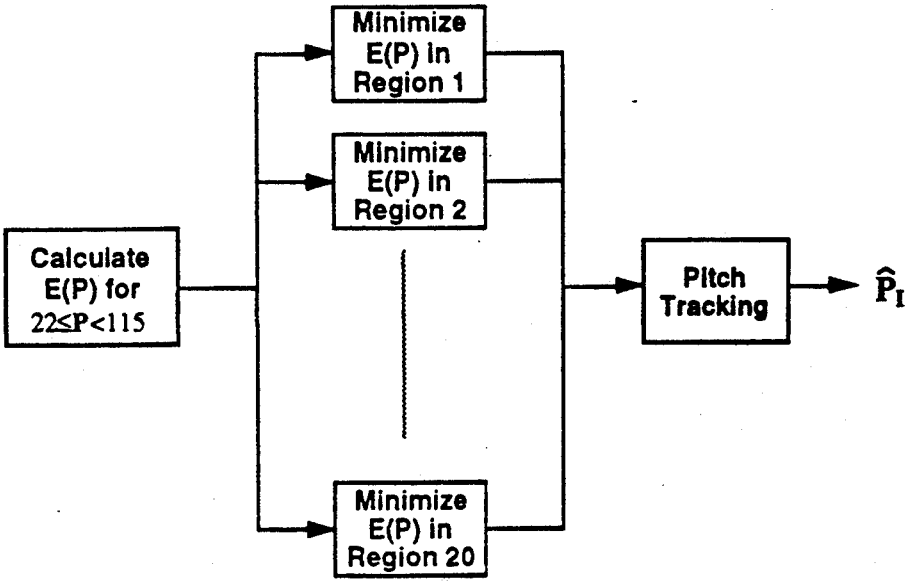
FIG. 7 is a flow chart showing a preferred embodiment of the invention in which pitch regions are used in making the pitch estimate.

Further substantial reduction in the number of regions will reduce computations but will also degrade the performance. If two candidate pitches fall in the same region, for example, the choice between the two will be strictly a function of which results in a lower E(P). In this case the benefits of pitch tracking will be lost. FIG. 7 shows a flow chart of the pitch estimation method which uses pitch regions to estimate the initial pitch.

Figure 8:
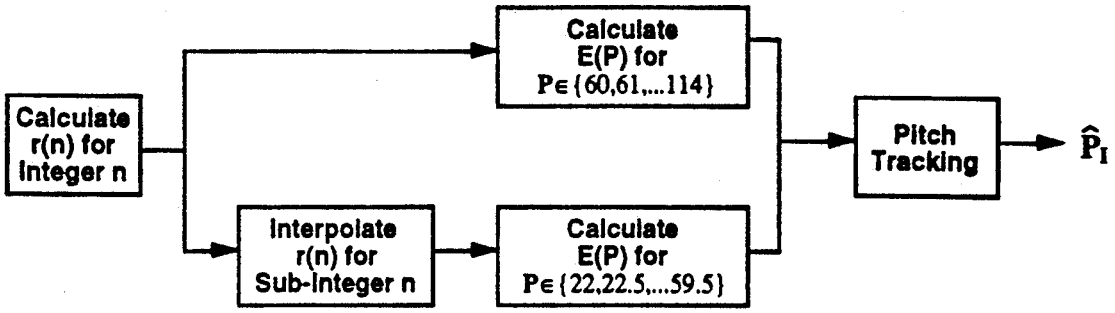
FIG. 8 is a flow chart showing a preferred embodiment of the invention in which pitch-dependent resolution is used in making the pitch estimate.

In various vocoders such as MBE and LPC, the pitch estimated has a fixed resolution, for example integer sample resolution or ½-sample resolution. The fundamental frequency, $\omega_0$, is inversely related to the pitch P, and therefore a fixed pitch resolution corresponds to much less fundamental frequency resolution for small P than it does for large P. Varying the resolution of P as a function of P can improve the system performance, by removing some of the pitch dependency of the fundamental frequency resolution. Typically this is accomplished by using higher pitch resolution for small values of P than for larger values of P. For example the function, E(P), can be evaluated with half-sample resolution for pitch values in the range $22\leqq P<60$, and with integer sample resolution for pitch values in the range $60\leqq P<115$. Another example would be to evaluate E(P) with half sample resolution in the range $22\leqq P<40$, to evaluate E(P) with integer sample resolution for the range $42\leqq P<80$, and to evaluate E(P) with resolution 2 (i.e. only for even values of P) for the range $80\leqq P<115$. The invention has the advantage that E(P) is evaluated with more resolution only for the values of P which are most sensitive to the pitch doubling problem, thereby saving computation. FIG. 8 shows a flow chart of the pitch estimation method which uses pitch dependent resolution.

The method of pitch-dependent resolution can be combined with the pitch estimation method using pitch regions. The pitch tracking method based on pitch regions is modified to evaluate E(P) at the correct resolution (i.e. pitch dependent), when finding the minimum value of E(P) within each region.

Figure 9:
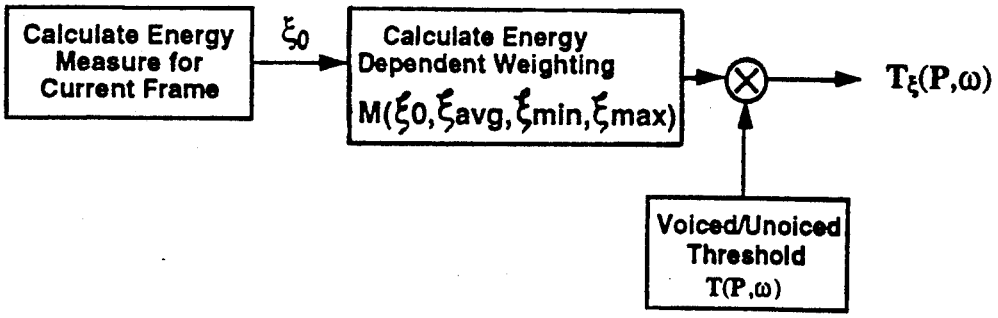
FIG. 9 is a flow chart showing a preferred embodiment of the invention in which the voiced/unvoiced decision is made dependent on the relative energy of the current segment and recent prior segments.

In prior vocoder implementations, the V/UV decision for each frequency band is made by comparing some measure of the difference between $S_\omega(\omega)$ and $S_\omega(\omega)$ with some threshold. The threshold is typically a function of the pitch P and the frequencies in the band. The performance can be improved considerably by using a threshold which is a function of not only the pitch P and the frequencies in the band but also the energy of the signal (as shown in FIG. 9). By tracking the signal energy, we can estimate the signal energy in the current frame relative to the recent past history. If the relative energy is low, then the signal is more likely to be unvoiced, and therefore the threshold is adjusted to give a biased decision favoring unvoicing. If the relative energy is high, the signal is likely to be voiced, and therefore the threshold is adjusted to give a biased decision favoring voicing. The energy dependent voicing threshold is implemented as follows. Let $\xi_0$ be an energy measure which is calculated as follows, $$\xi_0 = \int_{-\pi}^{\pi} H(\omega)|S_w(\omega)|^2 d\omega \quad (22)$$

where $S_\omega(\omega)$ is defined in (14), and $H(\omega)$ is a frequency dependent weighting function. Various other energy measures could be used in place of (22), for example, $$\xi_0 = \int_{-\pi}^{\pi} H(\omega)|S_w(\omega)| d\omega \quad (23)$$

The intention is to use a measure which registers the relative intensity of each speech segment.

Three quantities, roughly corresponding to the average local energy, maximum local energy, and minimum local energy, are updated each speech frame according to the following rules:

$$\xi_{avg} = (1-\gamma_0)\xi_{avg} + \gamma_0 \cdot \xi_0 \quad (24)$$

-continued $$\xi_{max} = \begin{cases} (1-\gamma_1)\xi_{max} + \gamma_1 \cdot \xi_0 & \text{if } \xi_0 > \xi_{max} \\ (1-\gamma_2)\xi_{max} + \gamma_2 \cdot \xi_0 & \text{if } \xi_0 \leqq \xi_{max} \end{cases} \quad (25)$$

$$\xi_{min} = \begin{cases} (1-\gamma_3)\xi_{min} + \gamma_3 \cdot \xi_0 & \text{if } \xi_0 \leqq \xi_{min} \\ (1-\gamma_4)\xi_{min} + \gamma_4 \cdot \xi_0 & \text{if } \xi_{min} \leqq \xi_0 < \mu \cdot \xi_{min} \\ (1+\gamma_4)\xi_{min} & \text{if } \xi_0 > \mu \cdot \xi_{min} \end{cases} \quad (26)$$

For the first speech frame, the values of $\xi_{avg}$, $\xi_{max}$, and $\xi_{min}$ are initialized to some arbitrary positive number. The constants $\gamma_0, \gamma_1, \ldots \gamma_4$, and $\mu$ control the adaptivity of the method. Typical values would be:

$\gamma_0=0.067$
$\gamma_1=0.5$
$\gamma_2=0.01$
$\gamma_3=0.5$
$\gamma_4=0.025$
$\mu=2.0$ The functions in (24) (25) and (26) are only examples, and other functions may also be possible. The values of $\xi_0$, $\xi_{avg}$, $\xi_{min}$ and $\xi_{max}$ affect the V/UV threshold function as follows. Let $T(P,\omega)$ be a pitch and frequency dependent threshold. We define the new energy dependent threshold, $T_\xi(P,W)$, by $$T_\xi(P,\omega) = T(P,\omega) \cdot M(\xi_0, \xi_{avg}, \xi_{min}, \xi_{max}) \quad (27)$$

where $M(\xi_0, \xi_{avg}, \xi_{min}, \xi_{max})$ is given by $$M(\xi_0, \xi_{avg}, \xi_{min}, \xi_{max}) = \quad (28)$$

$$\begin{cases} \lambda_0, \text{ if } \xi_{avg} \leqq \xi_{silence} \\ \dfrac{(\xi_{min}+\xi_0)(\xi_{max}+\lambda_1\xi_0)}{(\xi_0+\lambda_2\xi_{max})(\xi_0+\xi_{max})}, & \text{if } \xi_{avg} > \xi_{silence} \text{ and } \xi_{min} \geqq \lambda_2\xi_{max} \\ 1, & \text{if } \xi_{avg} > \xi_{silence} \text{ and } \xi_{min} \leqq \lambda_2\xi_{max} \end{cases}$$

Typical values of the constants $\lambda_0$, $\lambda_1$, $\lambda_2$ and $\xi_{silence}$ are:

$\lambda_0=0.5$
$\lambda_1=2.0$
$\lambda_2=0.0075$
$\xi_{silence}=200.0$

The V/UV information is determined by comparing $D_l$, defined in (19), with the energy dependent threshold, $$T_\xi\left(P, \frac{\Omega_i + \Omega_{i+1}}{2}\right).$$

If $D_l$ is less than the threshold then the l'th frequency band is determined to be voiced. Otherwise the l'th frequency band is determined to be unvoiced.

$T(P,\omega)$ in Equation (27) can be modified to include dependence on variables other than just pitch and frequency without effecting this aspect of the invention. In addition, the pitch dependence and/or the frequency dependence of $T(P\omega)$ can be eliminated (in its simplist form $T(P,\omega)$ can equal a constant) without effecting this aspect of the invention.

Figure 10:
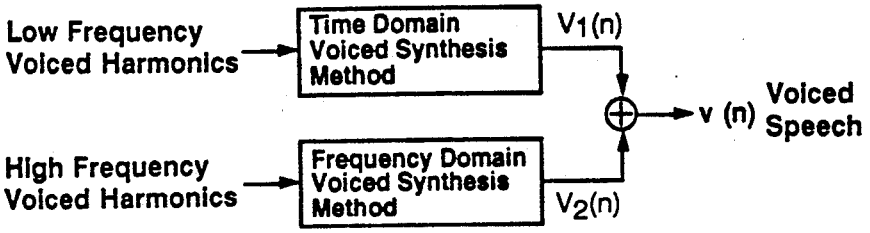
FIG. 10 is a block diagram showing a preferred embodiment of the invention in which a hybrid time and frequency domain synthesis method is used.

In another aspect of the invention, a new hybrid voiced speech synthesis method combines the advantages of both the time domain and frequency domain methods used previously. We have discovered that if the time domain method is used for a small number of low-frequency harmonics, and the frequency domain method is used for the remaining harmonics there is little loss in speech quality. Since only a small number of harmonics are generated with the time domain method, our new method preserves much of the computational savings of the total frequency domain approach. The hybrid voiced speech synthesis method is shown in FIG. 10.

Our new hybrid voiced speech synthesis method operates in the following manner. The voiced speech signal, v(n), is synthesized according to $$v(n) = v_1(n) + v_2(n) \quad (29)$$

where $v_1(n)$ is a low frequency component generated with a time domain voiced synthesis method, and $v_2(n)$ is a high frequency component generated with a frequency domain synthesis method.

Typically the low frequency component, $v_1(n)$, is synthesized by, $$\sum_{k=1}^{K} a_k(n) \cos \Theta_k(n) \quad (30)$$

where $a_k(n)$ is a piecewise linear polynomial, and $\Theta_k(n)$ is a low-order piecewise phase polynomial. The value of K in Equation (30) controls the maximum number of harmonics which are synthesized in the time domain. We typically use a value of K in the range $4 \leqq K \leqq 12$. Any remaining high frequency voiced harmonics are synthesized using a frequency domain voiced synthesis method.

In another aspect of the invention, we have developed a new frequency domain sythesis method which is more efficient and has better frequency accuracy than the frequency domain method of McAulay and Quatieri. In our new method the voiced harmonics are linearly frequency scaled according to the mapping $\omega_0 \rightarrow 2\pi/L$, where L is a small integer (typically $L<1000$). This linear frequency scaling shifts the frequency of the k'th harmonic from a frequency $\omega_k = k \cdot \omega_0$, where $\omega_0$ is the fundamental frequency, to a new frequency $2\pi k/L$. Since the frequencies $2\pi k/L$ correspond to the sample frequencies of an L-point Discrete Fourier Transform (DFT), an L-point Inverse DFT can be used to simultaneously transform all of the mapped harmonics into the time domain signal, $v_2(n)$. A number of efficient algorithms exist for computing the Inverse DFT. Some examples include the Fast Fourier Transform (FFT), the Winograd Fourier Transform and the Prime Factor Algorithm. Each of these algorithms places different constraints on the allowable values of L. For example the FFT requires L to be a highly composite number such as $2^7$, $3^5$, $2^4 \cdot 3^2$, etc . . . .

Because of the linear frequency scaling, $v_2(n)$ is a time scaled version of the desired signal, $v_2(n)$. Therefore $v_2(n)$ can be recovered from $v_2(n)$ through equations (31)–(33) which correspond to linear interpolation and time scaling of $v_2(n)$ $$v_2(n) = (1-\delta_n)v(m_n) + \delta_n \cdot v(m_n+1) \quad (31)$$

-continued $$m_n = \left\lfloor \frac{\omega_0 L n}{2\pi} \right\rfloor \text{ where } \lfloor x \rfloor = \text{the smallest interger} \leqq x \tag{32}$$

$$\delta_n = \frac{\omega_0 L n}{2\pi} - m_n \tag{33}$$

Figure 11:
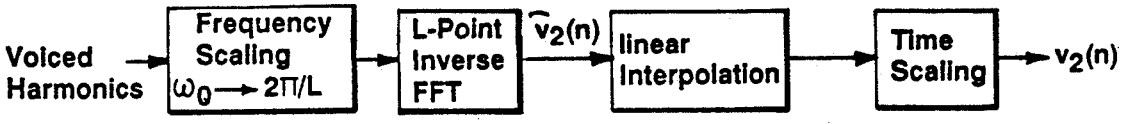
FIG. 11 is a block diagram showing a preferred embodiment of the invention in which a modified frequency domain synthesis is used.

Other forms of interpolation could be used in place of linear interpolation. This procedure is sketched in FIG. 11.

Other embodiments of the invention are within the following claims. Error function as used in the claims has a broad meaning and includes pitch likelihood functions.

We claim:

1. A method for encoding an acoustic signal, the method comprising the steps of:

A. breaking the signal into segments, each of the segments representing one of a succession of time intervals;

B. breaking each of said segments into a plurality of frequency bands; and

C. considering in turn each of the segments as the current segment, and for each of a plurality of said frequency bands of the current segment making a voiced/unvoiced decision by a method comprising the steps of:

evaluating a voicing measure for said frequency band;

making the voiced/unvoiced decision for said frequency band based upon a comparison between the voicing measure and a threshold;

determining an energy measure of the current segment;

determining a measure of the signal energy of one or more recent prior segments;

comparing the energy measure of the current segment to the measure of the signal energy of the one or more recent prior segments; and adjusting the threshold to make a voiced decision more likely when the energy measure of the current segment is greater than the measure of the signal energy of the one or more recent prior segments.

2. A method for encoding an acoustic signal, the method comprising the steps of:

A. breaking the signal into segments, each of the segments representing one of a succession of time intervals;

B. breaking each of said segments into a plurality of frequency bands; and

C. considering in turn each of the segments as the current segment, and for each of a plurality of said frequency bands of the current segment making a voiced/unvoiced decision by a method comprising the steps of:

evaluating a voicing measure for said frequency band;

making the voiced/unvoiced decision for said frequency band based upon a comparison between the voicing measure and a threshold;

determining an energy measure of the current segment;

determining a measure of the signal energy of one or more recent prior segments;

comparing the energy measure of the current segment to the measure of the signal energy of the one or more recent prior segments; and adjusting the threshold to make an unvoiced decision more likely when the energy measure of the current segment is less than the measure of the signal energy of the one or more recent prior segments.

3. The method of claim 2 comprising the further step of adjusting the threshold to make a voiced decision more likely when the energy measure of the current segment is greater than the measure of the signal energy of the one or more recent prior segments.

4. The method of claim, 1, 2 or 3 wherein the energy measure of the current segment $\xi_0$ is $$\xi_0 = \int_{-\pi}^{\pi} H(\omega)|S_w(\omega)|^2 d\omega$$

wherein $\omega$ is frequency, $H(\omega)$ is a frequency dependent weighting function, and $S_w(\omega)$ is the Fourier transform of the acoustic signal.

5. The method of claim 1, 2 or 3 wherein the voicing measure, $D_1$, is $$D_i = \frac{\int_{\Omega_i}^{\Omega_{i+1}} |S_w(\omega) - S_w(\omega)|^2 d\omega}{\int_{\Omega_i}^{\Omega_{i+1}} |S_w(\omega)|^2 d\omega}$$

wherein w is a windowing function, $S_w(\omega)$ is the Fourier transform of the acoustic signal, $S_w(\omega)$ is the voiced spectrum used to model the acoustic signal, $\omega$ is frequency, and $\Omega_i$ are the boundaries of the frequency bands.

6. The method of claim 1, 2 or 3 wherein said threshold, $T_\xi(P,\omega)$, is updated according to the equation $$T_\xi(P,\omega) = T(P,\omega) \cdot M(\xi_0, \xi_{avg}, \xi_{min}, \xi_{max})$$

wherein $\xi_0$ is the energy measure of the current segment, $\xi_{avg}$ is an average local energy calculated according to the recurrence equation $$\xi_{avg} = (1-\gamma_0)\xi_{avg} + \gamma_0 \cdot \xi_0$$

$\xi_{max}$ is a maximum local energy calculated according to the recurrence equation $$\xi_{max} = \begin{cases} (1-\gamma_1)\xi_{max} + \gamma_1 \cdot \xi_0 & \text{if } \xi_0 > \xi_{max} \\ (1-\gamma_2)\xi_{max} + \gamma_2 \cdot \xi_0 & \text{if } \xi_0 \leqq \xi_{max} \end{cases}$$

$\xi_{min}$ is a minimum local energy calculated according to the recurrence equation $$\xi_{min} = \begin{cases} (1-\gamma_3)\xi_{min} + \gamma_3 \cdot \xi_0 & \text{if } \xi_0 \leqq \xi_{min} \\ (1-\gamma_4)\xi_{min} + \gamma_4 \cdot \xi_0 & \text{if } \xi_{min} \leqq \xi_0 < \mu \cdot \xi_{min} \\ (1+\gamma_4)\xi_{min} & \text{if } \xi_0 > \mu \cdot \xi_{min} \end{cases}$$

$M(\xi_0, \xi_{avg}, \xi_{min}, \xi_{max})$ is calculated by the equation $$M(\xi_0, \xi_{avg}, \xi_{min}, \xi_{max}) =$$

-continued $$\begin{cases} \lambda_0, \text{ if } \xi_{avg} \leqq \xi_{silence} \\ \dfrac{(\xi_{min} + \xi_0)(\xi_{max} + \lambda_1\xi_0)}{(\xi_0 + \lambda_2\xi_{max})(\xi_0 + \xi_{max})}, & \text{if } \xi_{avg} > \xi_{silence} \text{ and } \xi_{min} \geqq \lambda_2\xi_{max} \\ 1, & \text{if } \xi_{avg} > \xi_{silence} \text{ and } \xi_{min} \leqq \lambda_2\xi_{max} \end{cases}$$

P is pitch, and $\lambda_0$, $\lambda_1$, $\lambda_2$, $\mu$, $\xi_{silence}$ $\gamma_0$, $\gamma_1$, $\gamma_2$, $\gamma_3$, $\gamma_4$, are constants.

7. A method for encoding an acoustic signal, the method comprising the steps of:

A. breaking the signal into segments, each of the segments representing one of a succession of time intervals;

B. considering in turn each of the segments as the current segment, and making a voiced/unvoiced decision for at least a frequency band of the current segment by a method comprising the steps of:

evaluating a voicing measure for said frequency band;

making the voiced/unvoiced decision for said frequency band based upon a comparison between the voicing measure and a threshold;

determining an energy measure of the current segment;

determining a measure of the signal energy of one or more consecutive preceding segments;

comparing the energy measure of the current segment to the measure of the signal energy of the consecutive preceding segments;

adjusting the threshold to make a voiced decision more likely when the energy measure of the current segment is greater than the measure of the signal energy of the consecutive preceding segments.

8. A method for encoding an acoustic signal, the method comprising the steps of:

A. breaking the signal into segments, each of the segments representing one of a succession of time intervals;

B. considering in turn each of the segments as the current segment, and making a voiced/unvoiced decision for at least a frequency band of the current segment by a method comprising the steps of:

evaluating a voicing measure for said frequency band;

making the voiced/unvoiced decision for said frequency band based upon a comparison between the voicing measure and a threshold;

determining an energy measure of the current segment;

determining a measure of the signal energy of one or more consecutive preceding segments;

comparing the energy measure of the current segment to the measure of the signal energy of the consecutive preceding segments;

adjusting the threshold to make a voiced decision less likely when the energy measure of the current segment is less than the measure of the signal energy of the consecutive preceding segments.

9. The method of claim 8 comprising the futher step of:

adjusting the threshold to make a voiced decision more likely when the energy measure of the current segment is greater than the measure of the signal energy of the consecutive preceding segments.

10. The method of any of claims 7, 8, or 9 wherein said consecutive preceding segments are those segments immediately preceding the current segment.

* * * * *

UNITED STATES PATENT AND TRADEMARK OFFICE

CERTIFICATE OF CORRECTION

PATENT NO. : 5,216,747

DATED : June 1, 1993

INVENTOR(S) : John C. Hardwick and Jae S. Lim

It is certified that error appears in the above-indentified patent and that said Letters Patent is hereby corrected as shown below:

On the title page:

Under [56] References Cited, U.S. PATENT DOCUMENTS, "Dunbnowski et al." should be --Dubnowski et al.--.

Col. 2, line 53, "$\hat{s}_w(n)$" should be --$s_w(n)$".

Col. 2, line 55, "$S_w(w)$" should be --$\hat{S}_w(w)$--.

Col. 2, line 61, "P" should be --$\hat{P}$--.

Col. 3, equation (1), in the denominator, the second occurrence of "$w^2$" should be --$w^4$--.

Col. 3, line 44, "$\hat{P}_{-2}$" should be --$P_{-2}$--.

Col. 3, line 63, "$P_I$" should be --$\hat{P}_I$--.

Col. 3, line 64, "looK" should be --look--.

Col. 4, line 17, insert a space between "$P_2$" and "is".

Col. 4, line 58, "$P_F$" should be --$\hat{P}_F$--.

UNITED STATES PATENT AND TRADEMARK OFFICE

CERTIFICATE OF CORRECTION

PATENT NO. : 5,216,747

DATED : June 1, 1993

INVENTOR(S) : John C. Hardwick and Jae S. Lim

It is certified that error appears in the above-indentified patent and that said Letters Patent is hereby corrected as shown below:

Col. 5, line 10, "$P_F$" should be --$\hat{P}_F$--.

Col. 5, line 11, "$P_F$" should be --$\hat{P}_F$--.

Col. 5, line 12, "$P_I$" should be --$\hat{P}_I$--.

Col. 5, equation (11), "$P_I=P_F$" should be --$\hat{P}_I=\hat{P}_F$--.

Col. 5, equation (12), "$(\hat{P}^*)$" should be --$(P^*)$--.

Col. 5, line 35, "$P_I$" should be --$\hat{P}_I$--.

Col. 5, equation (13), the first occurrence of "$\acute{S}$" should be "S".

Col. 5, equation (13), the second occurrence of "$\acute{S}$" should be --$\hat{S}$--.

Col. 6, line 1, "$S_w(\omega)$" should be --$\hat{S}_w(\omega)$--.

Col. 6, equation (18), "$\hat{S}_w(\omega)$" should be --$S_w(\omega)$--.

Col. 6, equation (18), "$S_w(\omega)$" should be --$\hat{S}_w(\omega)$--.

Col. 6, line 52, the second occurrence of "$S_w(\omega)$" should be --$\hat{S}_w(\omega)$--.

Col. 7, line 11, "sinusiodal" should be --sinusoidal--.

UNITED STATES PATENT AND TRADEMARK OFFICE

CERTIFICATE OF CORRECTION

PATENT NO. : 5,216,747

DATED : June 1, 1993

INVENTOR(S) : John C. Hardwick and Jae S. Lim

It is certified that error appears in the above-indentified patent and that said Letters Patent is hereby corrected as shown below:

Col. 9, line 33, "$P_1$" should be --$\hat{P}_1$--.

Col. 10, line 31, "$S_w(\omega)$" should be --$\hat{S}_w(\omega)$--.

Col. 11, equation at line 55, "P" should be --$\hat{P}$--.

Col. 11, equation at line 55, the numerator should read --$\Omega_l + \Omega_{l+1}$--.

Col. 12, line 52, "$v_2(n)$" should be "$\hat{v}_2(n)$.

Col. 12, line 60, "$v_2(n)$" should be "$\hat{v}_2(n)$.

UNITED STATES PATENT AND TRADEMARK OFFICE

CERTIFICATE OF CORRECTION

PATENT NO. : 5,216,747

DATED : June 1, 1993

INVENTOR(S) : John C. Hardwick and Jae S. Lim

It is certified that error appears in the above-indentified patent and that said Letters Patent is hereby corrected as shown below:

Col. 12, line 62, the second occurrence of "$v_2(n)$" should be "$\hat{v}_2(n)$.

Col. 12, line 64, "$v_2(n)$" should be "$\hat{v}_2(n)$.

Col. 12, equation (31), the second and third occurrence of "v" should be --$\hat{v}$--.

Col. 14, the equation in claim 5, the second occurrence of "$S_w(\omega)$" should be --$\hat{S}_w(\omega)$--.

Col. 14, the equation in claim 5, each occurrence of "i" should be "l".

Col. 14, line 33, "$S_w(\omega)$" should be --$\hat{S}_w(\omega)$--.

Col. 16, line 28, "futher" should be --further--.

Signed and Sealed this

First Day of March, 1994

Bruce Lehman

*Attest:*

BRUCE LEHMAN

*Attesting Officer*

*Commissioner of Patents and Trademarks*